US005718022A

United States Patent [19]

Vuillaume

[11] Patent Number: 5,718,022

[45] Date of Patent: Feb. 17, 1998

[54] METHOD FOR MAKING A NONWOVEN FABRIC LAP USING PRESSURIZED WATER JETS, AND APPARATUS THEREFORE

[75] Inventor: André Vuillaume, Biviers, France

[73] Assignee: ICBT Perfojet, Montbonnot, France

[21] Appl. No.: 718,376

[22] PCT Filed: Dec. 27, 1995

[86] PCT No.: PCT/FR95/01741

§ 371 Date: Sep. 27, 1996

§ 102(e) Date: Sep. 27, 1996

[87] PCT Pub. No.: WO96/23921

PCT Pub. Date: Aug. 8, 1996

[30] Foreign Application Priority Data

Feb. 3, 1995 [FR] France ..... 95 01473

[51] Int. Cl.[6] ..... C04H 5/02

[52] U.S. Cl. ..... 28/105; 28/104; 28/116; 28/122

[58] Field of Search ..... 28/103, 104, 105, 28/106, 116, 117, 122, 107, 124, 125, 126, 127, 128, 129, 130

[56] References Cited

U.S. PATENT DOCUMENTS 3,214,819 11/1965 Guerin .
3,485,706 12/1969 Evans .
3,508,308 4/1970 Bunting et al. .
3,917,785 11/1975 Kalwaites ..... 28/104
4,190,695 2/1980 Niederhauser .
5,098,764 3/1992 Drelich et al. .
5,136,761 8/1992 Sternlieb et al. ..... 28/104
5,301,401 4/1994 Suzuki et al. ..... 28/104
5,414,914 5/1995 Suzuki et al. ..... 28/105

FOREIGN PATENT DOCUMENTS 0446432 9/1990 European Pat. Off. .
0564306 10/1993 European Pat. Off. .

*Primary Examiner*—C. D. Crowder
*Assistant Examiner*—Larry D. Worrell, Jr.
*Attorney, Agent, or Firm*—Harris Beach & Wilcox, LLP

[57] ABSTRACT

A web of non woven textile fabric is fed on a porous belt into the nip between the belt and a rotating porous drum to compress the web within the nip. A curtain of water is passed through the web while it is in the nip into the drum and a vacuum is drawn on the drum to remove the water. The web, after passing the nip remains upon the drum and is subject to one or more high pressure jets of water to entangle the web fibers.

9 Claims, 1 Drawing Sheet

METHOD FOR MAKING A NONWOVEN FABRIC LAP USING PRESSURIZED WATER JETS, AND APPARATUS THEREFORE

FIELD OF THE INVENTION

The invention relates to a process for the manufacture of a lightweight nonwoven textile web using the technique known as pressurized "water jets"; the invention also relates to an apparatus for the implementation of this process.

PRIOR ART

In the documents U.S. Pat. Nos. 3,214,819, 3,485,706, 3,508,308 and 4,190,695, a process has been described for the manufacture of nonwoven textile webs in which the cohesion and the mutual interlacing of the elementary fibers is [sic] achieved by not using mechanical means but by using a plurality of high-pressure water jets passing through a moving fabric or web.

In the manner of needles, the water jets at a usual pressure of at least 30 bar, sometimes 100 bar and more, cause the mutual entanglement of the elementary fibers, which gives cohesion to the nonwoven web obtained. These nonwoven webs are known in the literature by the term "spun-lace web" or "spun lace". There is therefore no point in describing this hydroentangling technique in detail here.

This technique essentially consists in first producing a base web formed from natural or man-made elementary fibers or formed by a mixture of these fibers, especially on the carding machine or sliver-lap machine in order to obtain a highly aerated web having a thickness of several centimeters, or even ten centimeters, and weighing only a few tens of grams per square meter, for example one hundred grams for a thickness of 80 mm.

Next, the elementary fibers in this web are entangled by means of an injector rail of contiguous high-pressure (50 to 200 bar) water jets in order to bring the aerated base web to a thickness of about one to several millimeters.

In order to alleviate this drawback, it has been proposed to pass the moving aerated base web over a wetting injector rail or through an immersion tank. However, before subjecting the aerated web to the high-pressure water jets, it is necessary to compress it in order to reduce its volume. Thus, it has been suggested to compress the web by passing it between two rolls. Unfortunately, this means is not very effective, especially because the elasticity of the web which has a tendency to partially revert to its initial volume.

The invention alleviates these drawbacks.

BRIEF DESCRIPTION OF THE INVENTION

The subject of the invention is a process for the manufacture of a nonwoven textile web using water jets, in which:

- an aerated base web formed from elementary fibers is advanced;
- this base web is compressed;
- the fibers are entangled by means of at least one injector rail of contiguous high-pressure water jets acting on the base web; and
- the wet entangled fibrous web obtained is taken up.

According to the invention, this process is characterized in that, in a continuous manner:

- the base web is advanced positively on an endless porous support;
- this base web on the moving porous support is brought close to a perforated rotary cylindrical drum, inside which a partial vacuum is applied;

- the base web is mechanically compressed between the porous support and the rotary drum, which both advance substantially at the same speed;
- when the base web is compressed, a curtain of water is directed onto it, said curtain of water penetrating, in succession, the porous support, the compressed web and the perforated drum, so that the excess water is sucked up by the partial vacuum; and
- finally, the elementary fibers are entangled by directing the injector rail of high-pressure water jets onto the wet compressed web obtained.

The invention consists, of continuously, first in positively advancing the base web on an endless porous support, then in compressing the web when it is in place on this porous support using a perforated drum advancing at the same speed as the porous support, and thirdly wetting the compressed web using a curtain of slightly pressurized water acting through the assembly, namely the porous support, the compressed web and the rotary drum, so that the wet compressed web obtained adheres to the periphery, of the perforated rotary drum before undergoing, on this rotating drum, the entangling action of at least one injector rail of contiguous high-pressure water jets.

The dry web coming from the carding machine or silver-lap machine is compressed between a porous support fabric and a perforated rotary cylindrical drum and, after having been wetted beforehand, is subjected to hydroentangling in the wet compressed state on the same drum.

In practice, the vacuum inside the perforated rotary drum is between one hundred and one thousand millimeters of water column; because it has been observed that if this partial vacuum is less than 100 mm of water the web is too wet to be effectively entangled; likewise, if there is a partial vacuum greater than 1000 mm of water, no commensurate improvement is observed and energy is expended unnecessarily.

Advantageously, the moving endless porous support, that supports the aerated base web presses against a sector of the rotary drum in order to compress the web a short time before wetting. This results in slight entanglement of the elementary fibers, conducive to giving the wet compressed web a handling cohesion before the action of the high-pressure water jets which bring about the main entangling.

As already mentioned, the invention also relates to an apparatus that implements this process. This apparatus is characterized in comprising:

- an endless porous support conveyor, intended to receive an aerated fibrous base web formed from elementary fibers;
- means for driving this porous support;
- a perforated rotary cylindrical drum, comprising drive means, in synchronism with the speed of advance of the porous support, placed tangentially to the porous support by one of its generatrices;
- a hollow fixed cylindrical drum coaxial with the rotary cylindrical drum, connected to a vacuum source and having, along one of its generatrices, a first slot intended to be positioned close to the point where the porous support is tangential to the rotary drum;
- a first injector rail of water jets which is placed on the other side of the porous support with respect to the rotary drum and in alignment with the first slot;
- at least one second injector rail of high-pressure water jets which is placed close to the rotary drum, opposite a second slot lying along a generatrix of the fixed drum, in order to entangle the elementary fibers; and means for taking up the entangled wet compressed web obtained.

In practice, the endless porous support is a fabric made of man-made monofilament, especially polyester, having a porosity of between 30 and 60%, that is a ratio between the solid areas and the blank areas of between 30 and 60%, preferably close to 50%. The support should therefore be highly apertured to allow the slightly pressurized wetting water to pass through and to allow the curtain of water not only to wet the compressed web but to effect a light first entangling, conducive to the immediately following step in the process.

It has been observed that if the porosity of the fabric is less than 30% there is a loss of wetting effectiveness, because the water coming from the injector rail encounters the monofilaments too frequently. If the porosity is greater than 60%, it becomes difficult to compress effectively the aerated base web, because the elementary fibers have a tendency to pass through the network of the fabric.

The first injector rail of water jets, intended to form the continuous curtain of slightly pressurized water, is placed opposite the porous support fabric at a distance of between 10 and 100 mm from said porous support. The pressure of the water coming from these jets is between 3 and 15 bar, preferably approximately 5 to 8 bar. Below 3 bar, the curtain disperses too quickly and above 15 bar the additional cost is not justified. It is necessary that the curtain of water coming from the first injector rail strike the advancing and compressed moving base web perpendicularly to optimally wet it.

The perforated rotary drum intended to come into contact with the moving fabric is advantageously covered with a fabric made of steel or plastic monofilaments, having a porosity of between 10 and 20%, to allow evacuation of the water, at the same time remain compatible with the hydroentangling bonding.

In practice, the rotary drum has a diameter of between 300 and 1000 mm, to not unnecessarily increase the investment cost.

According to another characteristic of the invention, the perforated rotary cylindrical drum surrounds a hollow fixed coaxial cylindrical second drum connected to a source of partial vacuum to form a suction box. The fixed hollow drum has a vacuum of one hundred to one thousand millimeters of water column so that the water not retained by the web, coming either from the prewetting injector rail or from the entangling injectors, is properly removed.

The first slot, lying along the generatrix of the fixed inner drum opposite the water injector rail, has a width of between 10 and 20 mm to recover all the excess water from the injector rail not retained by the compressed web.

This wetting injector rail is formed from contiguous conventional injectors placed at predetermined distances to ensure formation of a continuous fine curtain.

As already mentioned, it is necessary that the linear speeds of the porous support and of the rotary drum be substantially equal to avoid shearing and slipping movements of the elementary fibers in the web.

Because throughout the process the aerated base web is held positively and because the curtain of wetting water exerts its action on a compressed web orthogonally and through a porous support, and because the prewetting water penetrates the web in its entirety to not only bring about a light first entangling but most importantly to be completely removed by the partial vacuum in the suction box, it follows that not only are the surface defects caused by the action of the low-pressure first jets eliminated but also the transfer of the web from the conveying porous support onto the periphery of the perforated rotary drum before the action of the high-pressure entangling water jets, is facilitated.

The compression effected between two porous surfaces facilitates the removal of the air from the aerated base web without disturbing the organization of the elementary fibers. Moreover, the slight partial vacuum in the fixed drum that forms the suction box ensures that the wet web is properly held against the periphery of the rotary drum, thereby ensureing that the web is transferred to the high-pressure entangling water jets.

Likewise, the wetting caused by the slight penetrating pressure makes it possible to successfully wet and treat hydrophobic fibers, such as polyester or polypropylene fibers, that present significant operational difficulties using techniques of the prior art.

It is important that the base web is compressed before it is wetted. It follows that, in practice, the point of impact of the wetting curtain must be placed immediately after the compression point where the moving porous support is tangential to the perforated rotary drum. Thus, the prewetting characteristic of the invention is effected on a compressed and firmly held web.

Next, the wet compressed web that is advancing on the rotary drum, is conventionally entangled using one or more parallel injector rails of high-pressure water jets, these injector rails possibly alternating, depending on the results desired. Each injector rail that is placed close to the rotary drum is parallel to the prewetting injector rail and is additionally placed opposite a slot made for this purpose along a generatrix of the fixed drum, forming the suction box.

The manner in which the invention is realized and the advantages which stem therefrom will become more apparent from the illustrative embodiment which follows, supported by the single appended figure.

BRIEF DESCRIPTION OF THE FIGURES

The single appended FIGURE is a diagrammatic representation of an installation in accordance with the invention.

MANNER OF REALIZING THE INVENTION

Figure 1:
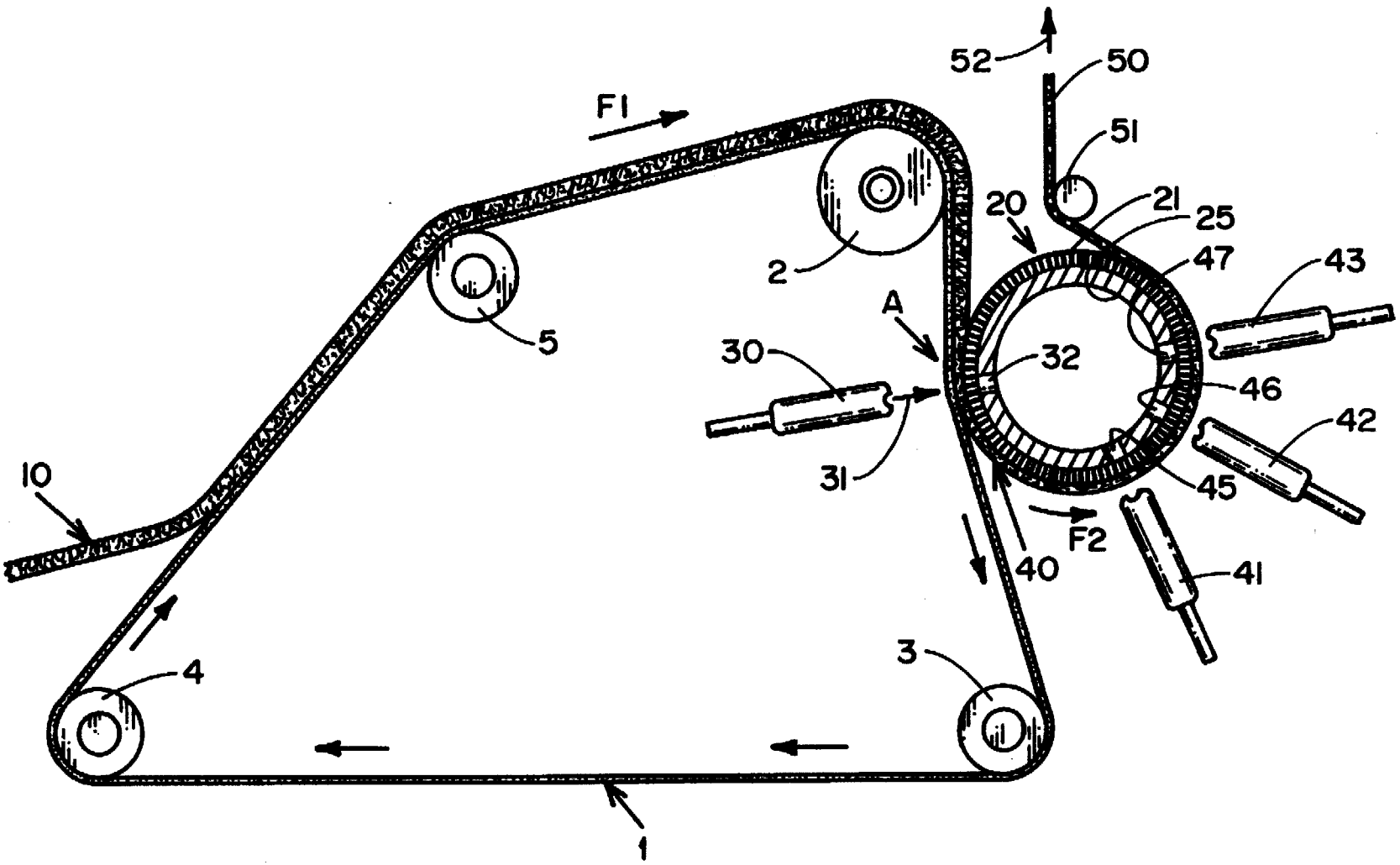

The installation in accordance with the invention comprises an endless porous conveyor (1), formed by a fabric made of polyester monofilaments, having a porosity of approximately 50%, that is a ratio between the solid areas and the blank areas of approximately one half. This endless fabric (1) is driven along by a drive roll (2), actuated by an asynchronous motor for example, and passes over idler guide rolls (3, 4, 5). Conventionally, the fabric (1) is tensioned using a tensioning cylinder, not shown.

Laid onto this moving fabric (1) is a base web, (10), coming from a conventional carding machine or sliver-lap machine, not shown. This web (10), which advances in the direction indicated by the arrow (F1), made of, for example, polyester fibers 60 mm in length, has at this stage an average thickness of eight centimeters and an average density of one hundred grams per square meter.

According to one characteristic of the invention, the installation comprises a perforated rotary cylindrical drum (20) placed in the immediate vicinity of and in contact with the fabric (1) on the descending portion lying between the drive roll (2) and the guide roll (3). This perforated rotary drum (20) is driven in rotation by an asynchronous motor, not shown, at the same linear peripheral speed as the speed of movement of the fabric (1). This rotary drum (20) is covered with a fabric, made of steel monofilaments, having a porosity of 15%.

As may be seen in the figure, the perforated rotary drum (20) is in contact with the fabric (1), which moves around a portion of a circular arc. In other words, there is intimate contact between the perforated rotary drum (20) and the porous support (1) over a portion of a circular arc, designated by the reference (A), of, for example, 10° to 20°. This intimate contact ensures that the web (10) is progressively compressed.

According to another characteristic of the invention, this rotary perforated cylindrical drum (20) has, on the inside, a coaxial hollow fixed cylindrical second drum (25) connected to a vacuum source, not shown, to form a suction box.

According to another characteristic of the invention, the installation comprises a first injector rail of water jets (30) placed to the left of the fabric (1) with respect to the zone (A) to form a curtain of water (31). directed orthogonally to the zone (A). The water leaves the injector rail (30) at a pressure of 5 bar.

According to another characteristic of the invention, the fixed hollow drum (25) forming the suction box has, in the alignment of the curtain of water (31), a window (32) fifteen millimeters in width lying along the entire generatrix of the cylinder (25), to suck up the excess water coming from the curtain of water (31).

It follows that the web (10), which advances on the porous support (1), is progressively compressed by being pinched between the porous support (1) and the perforated rotary drum (20), the porous support (1) and the rotating drum (20) advance at the same linear speed, and is then wetted by the curtain of water (31), and the excess water not retained by the compressed base web is sucked up into the central chamber (25). The wet compressed web (40) obtained is held against the periphery of the perforated rotary roll (20) by means of the reduced pressure in the central chamber (25).

This web (40), which advances in the direction of the arrow F2, is then subjected to the action of three injector rails, respectively (41, 42, 43) which direct a plurality of contiguous water jets at a pressure of 100 bar onto this web (40). Opposite each of the high-pressure jet injector rails (41, 42, 43), the hollow fixed central cylinder (25) has slots (45, 46, 47) which are similar to the window (32) and also lie along generatrices, to suck up and remove the entangling water.

The spun-lace entangled web (50) obtained is detached from the rotary cylinder (20) by passing over a turn roll (51), and then is conveyed at (52) to the rest of the usual entangling apparatus.

A spun-lace web (50) made of polyester fibers, having a density of 0.14 g/cm$^3$, is thus obtained.

The process and the apparatus according to the invention each allow successful treatment of hydrophobic fibers, or mixtures of these fibers with other, hydrophilic, fibers, and even webs of entirely natural fibers.

I claim:

1. A process for manufacture of a non-woven textile web that includes the steps of advancing an aerated base web containing elementary fibers upon a moving porous support into contact with a perforated rotatable drum, moving said drum at the same speed as said support, compressing the base web between the drum and the support within a compression zone, passing a curtain of water through said web while it is in the compression zone, drawing a vacuum inside said drum to remove said water, and directing at least one high pressure jet of water on the base web after it has left the compression zone to entangle the elementary fibers.

2. The process of claim 1 that includes the step of retaining the web on the drum after the web has left the compression zone wherein the high pressure water is drawn into the drum.

3. The process of claim 2 that includes the further step of maintaining between 100 and 1000 millimeters of water within said drum.

4. The process of claim 3 that includes the further step of compressing the base web against the drum for a given period before passing said curtain of water through said base well.

5. Apparatus for manufacturing a nonwoven textile web that includes an endless porous support arranged to carry an aerated base web formed of elementary fibers over a given path of travel, a perforated rotatable porous drum mounted adjacent the path of travel for compressing the base web between the porous support and the porous drum within a compression zone, drive means to rotate the porous drum at the same peripheral speed as the porous support, a stationary drum coaxially mounted inside the porous drum, said stationary drum having a first slotted opening extending across the stationary drum in the compression zone, a first injector rail mounted opposite the first slotted opening behind said porous support for directing a curtain of water through said web when said web is compressed between the support and the drum, means for drawing a vacuum inside said stationary drum whereby water passing through the web is drawn into said stationary drum through said slotted hole, at least one other slotted hole extending across said stationary drum downstream from said compression zone and at least one other injection rail mounted adjacent said stationary drum for directing a jet of water into said one other slotted hole, and take up means for holding the web against the porous drum after said web leaves the compression zone so that the jet of water entangles the elementary fibers of said web.

6. The apparatus of claim 5 wherein said porous support is formed of a monofilaments having a porosity of between 30 and 60%.

7. The apparatus of claim 5 wherein said porous drum is covered with steel monofilament fabric having a porosity of between 10 and 20%.

8. The apparatus of claim 5 wherein said porous drum has a diameter of between 300 and 1000 mm.

9. The apparatus of claim 5 wherein said first slotted hole has a width of between 10 and 20 mm and said first injector is positioned between 10 and 100 mm from the porous support and curtain of water is direst at the first slotted hole under a pressure of between 5 and 10 bars.

* * * * *